US008557101B2

(12) United States Patent
Greaney et al.

(10) Patent No.: US 8,557,101 B2
(45) Date of Patent: Oct. 15, 2013

(54) ELECTROCHEMICAL TREATMENT OF HEAVY OIL STREAMS FOLLOWED BY CAUSTIC EXTRACTION

(75) Inventors: Mark A. Greaney, Upper Black Eddy, PA (US); Kun Wang, Bridgewater, NJ (US); Frank C. Wang, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 237 days.

(21) Appl. No.: 13/232,500

(22) Filed: Sep. 14, 2011

(65) Prior Publication Data

US 2012/0000792 A1 Jan. 5, 2012

Related U.S. Application Data

(63) Continuation-in-part of application No. 12/288,565, filed on Oct. 21, 2008, now abandoned.

(60) Provisional application No. 61/008,413, filed on Dec. 20, 2007.

(51) Int. Cl.

| | |
|---|---|
| ***C10G 17/09*** | (2006.01) |
| ***C10G 31/00*** | (2006.01) |
| ***C10G 19/02*** | (2006.01) |
| ***C10G 32/02*** | (2006.01) |

(52) U.S. Cl.

USPC ..... 205/696; 208/208 R; 208/49; 208/226; 208/227; 208/237; 205/687; 205/688; 205/695; 204/168

(58) Field of Classification Search

USPC ..... 208/46, 49, 177, 208 R, 226, 227, 228, 208/229, 236, 237; 205/687, 688, 695, 696; 204/164, 168

See application file for complete search history.

(56) References Cited

U.S. PATENT DOCUMENTS

| | | | |
|---|---|---|---|
| 1,642,624 | A | 9/1927 | Northrup |
| 1,998,849 | A | 4/1935 | Schulze |
| 2,504,058 | A | 4/1950 | Unschule et al. |
| 3,409,520 | A | 11/1968 | Bolmer |
| 3,546,105 | A | 12/1970 | Jaffe |
| 3,788,978 | A | 1/1974 | Bearden, Jr. et al. |
| 3,915,819 | A | 10/1975 | Bell et al. |
| 4,043,881 | A | 8/1977 | Yen et al. |

(Continued)

FOREIGN PATENT DOCUMENTS

| | | | |
|---|---|---|---|
| CN | 1699519 | A | 5/2004 |

OTHER PUBLICATIONS

A. M. Aitani, M. F. Ali, H. H. Al-Ali; "A review of non-conventional methods for the desulfurization of residual fuel oil," Petroleum Science and Technology, 18(5&6), 537-553 (2000).

(Continued)

*Primary Examiner* — Walter D Griffin
*Assistant Examiner* — Derek Mueller
(74) *Attorney, Agent, or Firm* — Bruce M. Bordelon; Glenn T. Barrett

(57) ABSTRACT

This invention relates to a process for electrochemical conversion of dibenzothiophene type molecules of petroleum feedstreams selectively to mercaptan compounds that can then be more easily removed from the electrochemically treated product stream by either caustic extraction or thermal decomposition of the thiol functionality to hydrogen sulfide. The conversion of dibenzothiophenes to mercaptans is performed by electrochemical means in the substantial absence of hydrogen and in the substantial absence of water.

22 Claims, 2 Drawing Sheets

(56) References Cited

U.S. PATENT DOCUMENTS

| | | | |
|---|---|---|---|
| 4,043,885 | A | 8/1977 | Yen et al. |
| 4,045,313 | A | 8/1977 | Yen et al. |
| 4,066,739 | A | 1/1978 | Chen |
| 4,081,337 | A | 3/1978 | Spitzer |
| 4,204,923 | A | 5/1980 | Carpenter |
| 4,260,394 | A | 4/1981 | Rich |
| 4,362,610 | A | 12/1982 | Carpenter |
| 4,371,507 | A | 2/1983 | Furha, Jr. et al. |
| 4,849,094 | A | 7/1989 | Shmeleva et al. |
| 4,920,015 | A | 4/1990 | Sammells |
| 4,954,229 | A | 9/1990 | Kim et al. |
| 5,391,278 | A | 2/1995 | Honna et al. |
| 5,514,252 | A | 5/1996 | Kerby, Jr. et al. |
| 5,578,189 | A | 11/1996 | Joshi |
| 5,879,529 | A | 3/1999 | Greaney et al. |
| 5,935,421 | A | 8/1999 | Brons et al. |
| 6,132,590 | A | 10/2000 | Moran et al. |
| 6,238,530 | B1 | 5/2001 | Yoshida et al. |
| 6,241,871 | B1 | 6/2001 | Donini et al. |
| 6,274,026 | B1 | 8/2001 | Schucker et al. |
| 6,338,788 | B1 | 1/2002 | Schucker |
| 6,368,495 | B1 | 4/2002 | Kocal et al. |
| 6,402,940 | B1 | 6/2002 | Ruppus |
| 6,497,973 | B1 | 12/2002 | Amendola |
| 6,824,673 | B1 | 11/2004 | Ellis et al. |
| 7,244,351 | B2 | 7/2007 | Baez et al. |
| 2003/0102123 | A1 | 6/2003 | Wittle et al. |
| 2005/0161217 | A1 | 7/2005 | Wittle et al. |
| 2006/0102523 | A1 | 5/2006 | Baez et al. |
| 2006/0254930 | A1 | 11/2006 | Martinie et al. |
| 2007/0108101 | A1 | 5/2007 | Baez et al. |
| 2007/0175798 | A1 | 8/2007 | Fokema et al. |
| 2009/0145806 | A1 | 6/2009 | Hamad |

OTHER PUBLICATIONS

Cesar Ovalles, Iraima Rojas, Socrates Acevedo, Gaston Escobar, Gilberto Jorge, Luis B. Gutierrez, Alfredo Rincon, Benjamin Scharifker; "Upgrading of Orinoco Belt crude oil and its fractions by an electrochemical system in the presence of protonating agents," Fuel Processing Technology 48 (1996) 159-172.

N. Ignatev, et al., New Ionic Liquids with TRIS(Perfluoroalkyl)Trifluorophosphate (FAP Anions, 126 J. Fluorine Chem., 1150-1159, 2005.

Sunderland, "Impact of Future Fuel Specifications on Bitumen Upgrading", Proceedings of the World Petroleum Congress, 2000, 16th, vol. 3, pp. 70-77.

Knudsen et al., "Catalyst and Process Technologies for Ultra Low Sulfur Diesel", Applied Catalysis A: General, 1999, vol. 189, pp. 205-215.

Mossner, "Determination of Polycyclic Aromatic Sulfur Heterocycles in Fossil Fuel-Related Samples", Anal. Chem., 1999, pp. 58-69.

ELECTROCHEMICAL TREATMENT OF HEAVY OIL STREAMS FOLLOWED BY CAUSTIC EXTRACTION

This Application is a Continuation-in-Part Application which claims the benefit of U.S. Non-Provisional application Ser. No. 12/288,565 filed Oct. 21, 2008, which claims the benefit of U.S. Provisional Application No. 61/008,413 filed Dec. 20, 2007.

FIELD OF THE INVENTION

This invention relates to a process for electrochemical conversion of dibenzothiophene type molecules of petroleum feedstreams selectively to mercaptan compounds that can then be more easily removed from the petroleum stream by either caustic extraction of the mercaptan compound or by thermal decomposition of the thiol functionality (—SH) on the mercaptan to hydrogen sulfide. The conversion of dibenzothiophenes to mercaptans is performed by electrochemical means in the substantial absence of hydrogen and in the substantial absence of water.

BACKGROUND OF THE INVENTION

The sulfur content of petroleum products is continuing to be regulated to lower and lower levels throughout the world. Sulfur specifications in motor gasoline ("mogas") and on-road diesel have been most recently reduced and future specifications will further lower the allowable sulfur content of off-road diesel and heating oils. Sulfur is currently removed from petroleum feedstreams by various processes depending on the nature of the feedstream. Processes such as coking, distillation, and alkali metal dispersions are primarily used to remove sulfur from heavy feedstreams, such as bitumens which are complex mixtures and typically contain hydrocarbons, heteroatoms, and metals, with carbon chains in excess of about 2,000 carbon atoms. For lighter petroleum feedstreams, such as distillates, catalytic hydrodesulfurization is typically used. The sulfur species in such feedstreams span a range of molecular types including sulfides, thiols, thiophenes, benzothiophenes to dibenzothiophenes in order of decreasing hydrodesulfurization (HDS) reactivity. The most difficult to remove sulfur is found in sterically hindered dibenzothiophene molecules such as diethyl dibenzothiophene. The space velocity, temperature and hydrogen pressures of catalytic HIDS units are determined primarily by the slow reaction kinetics of these relatively minor components of the feed. These are the molecules that are typically left in the product after conventional low-pressure hydrotreating. Further removing these molecules often requires higher hydrogen pressure and higher temperature ("deep desulfurization") which leads to higher hydrogen consumption and shorter catalyst run lengths which are costly results. Therefore, it is desirable to have alternative processes that are capable of removing these refractory sulfur molecules without incurring more severe reaction conditions for catalytic hydrotreating, which can result in significant capital and energy savings.

SUMMARY OF THE INVENTION

In accordance with a preferred embodiment of the present invention there is provided a process for removing sulfur from a sulfur-containing petroleum feedstream having at least a portion of its sulfur in the form of hindered dibenzothiophene compounds, comprising:

a) passing a sulfur-containing petroleum feedstream to an electrochemical cell in the substantial absence of hydrogen and in the substantial absence of water;

b) subjecting said sulfur-containing petroleum feedstream to an effective voltage and current that will result in the conversion of at least 5 wt % of said hindered dibenzothiophene compounds wherein at least 25 wt % of these converted hindered dibenzothiophene compounds are mercaptan compounds, thereby producing an electrochemically treated petroleum feedstream;

c) passing the electrochemically treated petroleum feedstream containing said mercaptans compounds to a mercaptan treatment zone wherein it is contacted with an aqueous caustic solution wherein mercaptan-containing compounds are extracted by the aqueous caustic solution; and d) collecting a reduced mercaptan sulfur petroleum product stream from the mercaptan treatment zone;

wherein the reduced mercaptan sulfur petroleum product stream has a lower sulfur content by wt % than the electrochemically treated petroleum feedstream.

In a further improved embodiment, the mercaptan treatment zone comprises contacting the electrochemically treated petroleum feedstream with an aqueous caustic solution wherein mercaptan-containing compounds are extracted by the aqueous caustic solution; and producing the reduced mercaptan sulfur petroleum product stream of step d).

In another further improved embodiment, the mercaptan treatment zone comprises thermal decomposing zone wherein at least a portion of the thiol functionality of the mercaptans in the electrochemically treated petroleum feedstream is decomposed to hydrogen sulfide at temperatures from about 302° F. to about 932° F. (150° C. to 500° C.); and producing the reduced mercaptan sulfur petroleum product stream of step d).

In a preferred embodiment, the sulfur-containing petroleum feedstream is comprised of a heavy oil selected from bitumen, crude oil, atmospheric resid and vacuum resid. In a preferred embodiment, the sulfur-containing petroleum feedstream is comprised of at least 50 wt % bitumen.

In a another preferred embodiment, the sulfur-containing petroleum feedstream is substantially absent of any electrolytes and the sulfur-containing petroleum feedstream in step b) is at a temperature of at least 300° C. (572° F.).

In another preferred embodiment, the feedstream is a distillate boiling range hydrocarbon stream and an effective amount of an electrolyte is mixed with the distillate boiling range stream to be treated.

In another preferred embodiment, the electrochemically treated petroleum feedstream has a higher mercaptan sulfur content by wt % than the sulfur-containing petroleum feedstream.

DETAILED DESCRIPTION OF THE INVENTION

Figure 1:
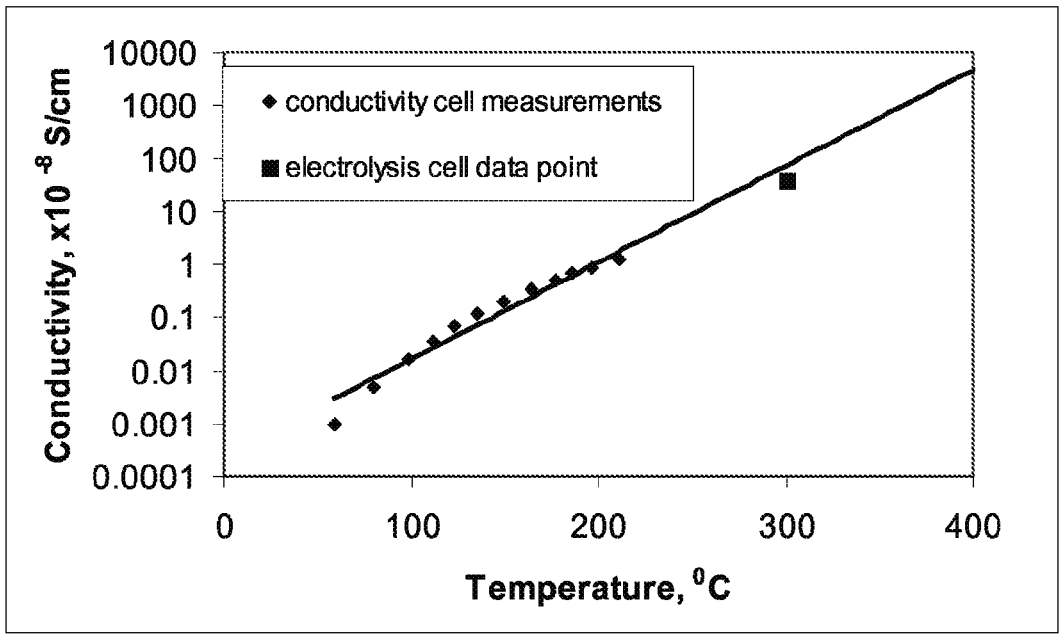
FIG. 1 hereof is a plot of measured electrical conductivity versus temperature for an Athabasca bitumen plotted on an exponential scale.

Feedstreams suitable for use in the present invention range from heavy oil feedstreams, such as bitumens to those boiling in the distillate range. In a preferred embodiment the heavy oil feedstream contains at least about 10 wt. %, preferably at least about 25 wt. % of material boiling above about 1050° F. (565° C.), both at atmospheric pressure (0 psig). Such streams include bitumens, heavy oils, whole or topped crude oils and residua. The bitumen can be whole, topped or froth-treated bitumen. Non-limiting examples of distillate boiling range streams that are suitable for use herein include diesel fuels, jet fuels, heating oils, kerosenes, and lubes. Such streams typically have a boiling range from about 302° F. (150° C.) to about 1112° F. (600° C.), preferably from about 662° F. (350° C.) to about 1022° F. (550° C.). Other preferred streams are those typically known as Low Sulfur Automotive Diesel Oil ("LSADO"). LSADO will typically have a boiling range of about 350° F. (176° C.) to about 550° F. (287° C.) and contain from about 200 wppm sulfur to about 2 wppm sulfur, preferably from about 100 wppm sulfur to about 10 wppm sulfur. The process embodiments of the present invention electrochemically treat a sulfur-containing petroleum feedstream resulting in a reduced-sulfur petroleum product stream which has a lower sulfur concentration by wt % than the sulfur-containing petroleum feedstream.

A majority of the sulfur contained in heavy oils and distillates are in the form of hindered dibenzothiophene molecules. Although such molecules are difficult to remove by conventional hydrodesulfurization processes without using severe conditions, such as high temperatures and pressures, such molecules are converted by the practice of the present invention to sulfur species that are more easily removed by conventional non-catalytic processes. For example, the electrochemical step of the present invention converts the hindered dibenzothiophene ("DBT") molecules, which are substantially refractory to conventional hydrodesulfurization, to hydrogenated naphthenobenzothiophene mercaptan molecules that are more readily extracted with use of caustic solution or by thermal decomposition. This capability can significantly debottleneck existing distillate hydrotreating process units by converting the slowest to convert molecules (hindered dibenzothiophenes) into much more readily extractable mercaptan species, preferably alkylated biphenyl mercaptan species.

The electrochemical cell used in the practice of the present invention may be divided or undivided. Such systems include stirred batch or flow through reactors. The foregoing may be purchased commercially or made using technology known in the art. Suitable electrodes known in the art may be used. Included as suitable electrodes are three-dimensional electrodes, such as carbon or metallic foams. The optimal electrode design would depend upon normal electrochemical engineering considerations and could include divided and undivided plate and frame cells, bipolar stacks, fluidized bed electrodes and porous three dimensional electrode designs; see *Electrode Processes and Electrochemical Engineering* by Fumio Hine (Plenum Press, New York 1985). While direct current is typically used, electrode performance may be enhanced using alternating current or other voltage/current waveforms. The gap between electrode surfaces will preferably be about 1 to about 50 mm, more preferably from about 1 to about 25 mm, and the linear velocity in the electrochemical cell will be in the range of about 1 to about 500 cm/s, more preferably in the range of about 50 to about 200 cm/s.

The applied cell voltage, that is, the total voltage difference between the cathode and anode will vary depending upon the cell design and electrolytes used. What is critical, however, is that the cathode be polarized sufficiently to achieve electron transfer to the dibenzothiophene molecules, which occurs at reduction potentials more negative than −2.3 Volts versus a standard calomel electrode. Normal electrochemical practices can be used to ensure that the cell is operated under these conditions. In preferred embodiments, the voltage across the electrochemical cell will be about 4 to about 500 volts, preferably from about 100 to about 200 volts, with a resulting current density of about 10 mA/cm$^2$ to about 1000 mA/cm$^2$, preferably from about 100 mA/cm$^2$ to about 500 mA/cm$^2$.

In a first embodiment of the present invention, at least a portion of the hindered dibenzothiophene compounds in the feedstream are selectively converted to mercaptan sulfur compounds which can more easily be removed from the electrochemically treated stream. Preferably, at least a portion of the hindered dibenzothiophene compounds are converted to the corresponding alkylated biphenyl mercaptan compounds in the electrochemical cell. In the invention, the conversion of the feedstream in the electrochemical cell is performed in the substantial absence of hydrogen and water. Even more preferably, the conversion of the feedstream in the electrochemical cell is performed in the substantial absence of both hydrogen and water and in the presence of an inert gas atmosphere such as nitrogen. By the term "substantial absence of hydrogen and water" it is meant that the sulfur-containing feedstream to the electrochemical cell has no added hydrogen or hydrogen-containing streams added to the feedstream as well as no water or water-containing streams added to the feedstream. By the term "hydrogen or hydrogen-containing streams" it is meant streams containing molecular hydrogen. In preferred embodiments, the sulfur-containing feedstream contains less than less than 1 wt %, and more preferably less than 0.5 wt %, molecular hydrogen. Most preferably, the sulfur-containing feedstream contains only trace amounts of molecular hydrogen. In preferred embodiments, the sulfur-containing feedstream contains less than less than 2 wt %, and more preferably less than 1 wt %, water. Most preferably, the sulfur-containing feedstream contains only trace amounts of water.

The mercaptan containing electrochemically treated feedstream can then be passed to a caustic wash step wherein it is contacted with an aqueous caustic solution for extraction of the mercaptan species. Any suitable caustic wash technology can be used in the practice of the present invention. The most preferred caustic wash would be an aqueous solution of sodium hydroxide having a strength from about 0.5 M to about 5 M and mixing the mercaptan-containing stream with air and the caustic solution to remove the mercaptan species in the caustic solution. Non-limiting examples of caustic extraction processes that can be used in the practice of the present invention include the UOP® MEROX® process and the Merichem® THIOLEX® and EXOMER® processes. The MEROX® Process was announced to the industry in 1959. The Oil & Gas J. 57(44), 73-8 (1959) contains a discussion of the MEROX® Process. In the MEROX® oxidation process, mercaptan compounds are extracted from the feed and then oxidized by air in the caustic phase in the presence of the MEROX® catalyst, which is typically an iron group chelate (cobalt phthalocyanine) to form disulfides which are then redissolved in the hydrocarbon phase, leaving the process as disulfides in the hydrocarbon product. The disulfides, which are not soluble in the caustic solution, can be separated and recycled for mercaptan extraction. The treated stream is usually sent to a water wash in order to reduce the sodium content.

All of these processes take advantage of the acidity of the mercaptan species. By contacting a petroleum stream that contains acidic mercaptan species with an aqueous base solution, the mercaptans are deprotonated, converted to salts and are now more soluble in the aqueous stream and thus can be extracted nearly quantitatively from the petroleum stream.

Such an extraction is ineffective with the original, non-acidic dibenzothiophenic sulfur species. The desulfurized petroleum stream is then separated from the resulting mercaptide containing caustic solution. The caustic solution can then be regenerated and the mercaptides isolated in a variety of conventional ways depending on the process design. Such mercaptan extractions are widely used in the petroleum refining industry and it is likely that every refinery has at least one such unit. The extracted mercaptans can be readily oxidized to disulfides, separated from the caustic stream, and recycled for more mercaptan extraction. The hindered dibenzothiophene ("DBT") species which are removed from the feedstream are converted to a relatively small substantially pure stream of disulfides that can be disposed of via combustion. They can also be fed to a coking unit for thermal decomposition. Being able to target hindered DBT molecules can also enable the disposition of Light Catalytic Cycle Oil ("LCCO"), which is rich in DBTs, to distillate hydrotreaters.

Conversely to removal of the mercaptan sulfurs with a caustic wash, a thermal decomposition reaction of the resulting mercaptans is performed either following, or simultaneous with the electrochemical conversion of the dibenzothiophenic species to mercaptans, to decompose the mercaptan sulfur compounds with a loss of hydrogen sulfide from the mercaptan molecule. This thermal decomposition can be performed at temperatures from about 302° F. to about 932° F. (150° C. to 500° C.), preferably from about 482° F. to about 932° F. (250° C. to 500° C.) and at ambient to autogenous pressure. Subsequent removal of this hydrogen sulfide from the petroleum stream will produce a reduced sulfur product stream that is lower is sulfur content by wt % than the sulfur-containing petroleum feedstream treated by the current process.

This first embodiment of the present invention will be better understood with reference to the following examples which are presented for illustrative purposes and are not to be taken as limiting the invention in anyway.

The following Example 1 and Comparative Example 1A were performed using a 300-cc autoclave (Parr Instruments, Moline, Ill.) was modified to allow two insulating glands (Conax, Buffalo, N.Y.) to feed through the autoclave head. Two cylindrical stainless steel (316) mesh electrodes are connected to the Conax glands, where the power supply (GW Laboratory DC Power Supply, Model GPR-1810HD) is connected to the other end. The autoclave body is fitted with a glass insert, a thermal-couple and a stirring rod. The autoclave can be charged with desired gas under pressure and run either in a batch- or a flow-through mode.

Example 1

Electrochemical Treatment of DBT Under $N_2$ in Dimethyl Sulfoxide Solvent With Tetrabutylammonium Hexaflouorphosphate Electrolyte To the glass insert was added 1.0 g dibenzothiophene ("DBT"), 3.87 g tetrabutylammonium hexafluorophosphate ($TBAPF_6$), and 100 milliliter ("ml") anhydrous dimethyl sulfoxide (DMSO, Aldrich). After the contents were dissolved, the glass insert was loaded into the autoclave body, the autoclave head assembled and pressure tested. The autoclave was charged with 70 psig of $N_2$ and heated to 212° F. (100° C.) with stirring (300 rpm). A voltage of 5 Volts was applied and the current was 0.8 Amp. The current gradually decreased with time and after two hours, the run was stopped. The autoclave was opened and the content acidified with 10% HCl (50 ml). The acidified solution was then diluted with 100 ml of de-ionized ("DI") water, extracted with ether (50 ml×3). The ether layer was separated and dried over anhydrous $Na_2SO_4$, and ether was allowed to evaporate under a stream of $N_2$, The isolated dry products were analyzed by GC-MS. A conversion of 12% was found for DBT and the products are as the following.

[1]

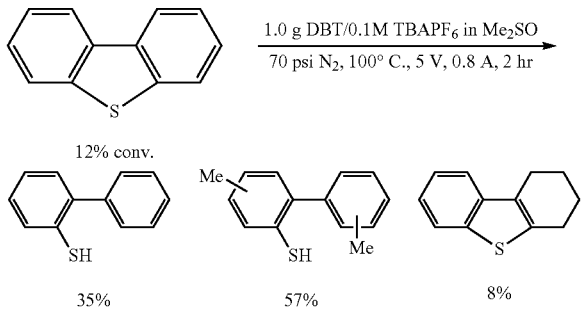

This example shows that the electrochemical reduction of DBT under $N_2$ resulted in: 12% DBT conversion after 2 h at 212° F. GC-MS revealed that the products consisted of 35% 2-phenyl benzenethiol, 8% tetrahydro-DBT, and 57% of a species with a mass of 214. The assignment of this peak as 2-phenyl benzenethiol was done by comparing with an authentic sample. The mass 214 species was tentatively assigned as 2-phenyl benzenethiol with two methyl groups added. Addition of methyl groups to DBT indicates that decomposition of solvent DMSO occurred since it is the only source of methyl groups in this system. No desulfurization product biphenyl was observed in this run.

Comparative Example 1A

Electrochemical Treatment of DBT Under Hydrogen in Dimethyl Sulfoxide Solvent with Tetrabutylammonium Hexaflouorphosphate Electrolyte To the glass insert was added 0.5 g dibenzothiophene ("DBT"), 3.87 g tetrabutylammonium hexafluorophosphate ($TBAPF_6$), and 100 ml anhydrous dimethyl sulfoxide (DMSO, Aldrich). After the contents were dissolved, the glass insert was loaded into the autoclave body, the autoclave head assembled and pressure tested. The autoclave was charged with 300 psig of $H_2$ and heated to 257° F. (125° C.) with stirring (300 rpm). A voltage of 4.5 Volts was applied and the current was 1.0 Amp. The current gradually decreased with time and after three and half (3.5) hours, the run was stopped. The autoclave was opened and the content acidified with 10% HCl (50 ml). The acidified solution was then diluted with 100 ml of DI water, extracted with ether (50 ml×3). The ether layer was separated and dried over anhydrous $Na_2SO_4$, and ether was allowed to evaporate under a stream of $N_2$. The isolated dry products were analyzed by GC-MS. A conversion of 16.5% was found for DBT and the products are as the following.

[2]

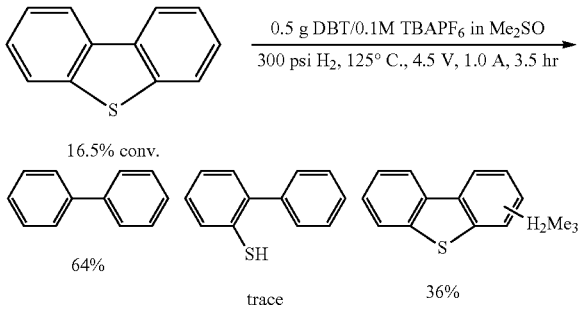

As can be seen comparing the reaction products of the present invention (shown in Example 1 and the reaction products [1]). A substantial amount of dibenzothiophenes were converted to other species. However, it should be noted that when the electrochemical reaction is run in the absence of hydrogen (i.e., with a nitrogen inert environment), approximately 82 wt % (35 wt %+57 wt %) of the conversion products were easily removable mercaptan sulfur compounds (—SH groups). In contrast, when the electrochemical reaction was run in the presence of hydrogen (shown in Comparative Example 1A and the reaction products [2]), there were almost no mercaptan sulfur compound products and essentially all of the sulfur species remaining in the converted sulfur products were hindered dibenzothiophenes species (36 wt %).

As can be seen, by operating the invention in the absence of both hydrogen and water and more preferably with an inert atmosphere (such as nitrogen as used in Example 1), the conversion of the dibenzothiophenes can be highly selectively tailored to the production of mercaptan sulfur compounds which can be easily removed by either caustic extraction or thermal treatment. As noted before, in contrast, the dibenzothiophenes species in the products are not extractable with caustic nor readily thermally decomposed and typically require severe catalytic hydroprocessing for their removal.

In the present invention, preferably at least 5 wt %, and more preferably at least 10 wt % of said hindered dibenzothiophene compounds in the electrochemically treated feedstream are converted into other (i.e., non-hindered dibenzothiophene) species. In the present invention, of these converted species, preferably at least 25 wt %, and more preferably at least 50 wt % of these converted hindered dibenzothiophene compounds are mercaptan compound species. These mercaptan compound species can then be easily removed from the electrochemically treated hydrocarbon feedstreams by simpler, less costly "non-catalytic hydroprocessing" methods.

The examples above illustrate that DBTs can be readily converted electrochemically wherein at least a portion of the DBT conversion products (more preferably at least 25 wt % of the DBT conversion products) are alkylated biphenyl mercaptans. This electrochemical conversion can be performed without the addition of hydrogen or water. The resulting mercaptan compounds can be removed by caustic extraction for example. These comparative examples demonstrate that, electrochemical reduction in the presence of hydrogen leads to production of hydrogenated naphtheno dibenzothiophenes and not biphenyl mercaptans. These species are not caustic extractable. By limiting the availability of hydrogen sources by eliminating the hydrogen or water content, the products of the electrolysis can be controlled. The chemistry of conversion to biphenyl mercaptans and subsequent extraction processes are as follows:

[4]

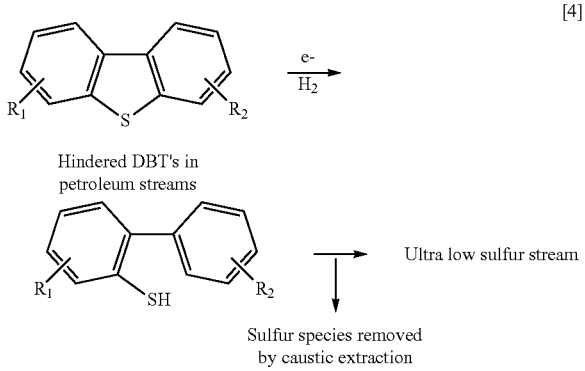

Examples 2 through 5 below illustrate that as an alternative to caustic extraction, the resulting mercaptan species can easily be removed by thermal decomposition into hydrogen sulfide.

Example 2

Thermal Decomposition of 2-Phenylthiophenol in Tetralin at 400° C.

A volume of 1.5 ml of a tetralin solution containing 0.1 M of 2-phenylthiopheol was placed into 3 ml stainless-steel mini-bomb inside a dry-box. The mini-bomb was heated at 400° C. in an oven for a certain period of time and the content analyzed by GC/MS. Results in Table 1 below indicate desulfurization of 2-phenylthiophenol, giving biphenyl as the major product.

Example 3

Thermal Decomposition of 2-Phenylthiophenol in Tetralin at 375° C.

A volume of 1.5 ml of a tetralin solution containing 0.1 M of 2-phenylthiopheol was placed into 3 ml stainless-steel mini-bomb inside a dry-box. The mini-bomb was heated at 375° C. in an oven for a certain period of time and the content analyzed by GC/MS. Results in Table 1 below indicate desulfurization of 2-phenylthiophenol, giving biphenyl as the major product.

Example 4

Thermal Decomposition of 2-Phenylthiophenol in Tetralin at 350° C.

A volume of 1.5 ml of a tetralin solution containing 0.1 M of 2-phenylthiopheol was placed into 3 ml stainless-steel mini-bomb inside a dry-box. The mini-bomb was heated at 350° C. in an oven for a certain period of time and the content analyzed by GC/MS. Results in Table 1 below indicate desulfurization of 2-phenylthiophenol, giving biphenyl as the major product. Based on the thermal decomposition rates at various temperatures, the activation energy for 2-phenylthiophenol thermal decomposition was determined to be ~29.2 kcal/mol.

Example 5

Thermal Decomposition of Phenyl Disulfide in Tetralin at 300° C.

A volume of 1.5 ml of a tetralin solution containing 0.1 M of phenyl disulfide (PhS—SPh) was placed into 3 ml stainless-steel mini-bomb inside a dry-box. The mini-bomb was heated at 572° F. (300° C.) in an oven for 4 h and the content analyzed by GC/MS. All disulfide is converted into thiophenol. By analogy, biphenyl disulfide (Ph-Ph-S—S-Ph-Ph) can be converted into 2-phenylthiophenol, which can be desulfurized at higher temperature as shown in Examples 2 through 4 herein. Equation 5 illustrates the thermal conversion of 2-phenylthiophenol to biphenyl and hydrogen sulfide.

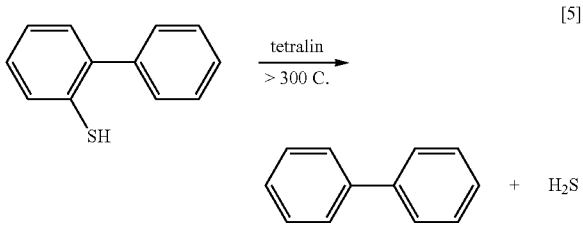

Figure 2:
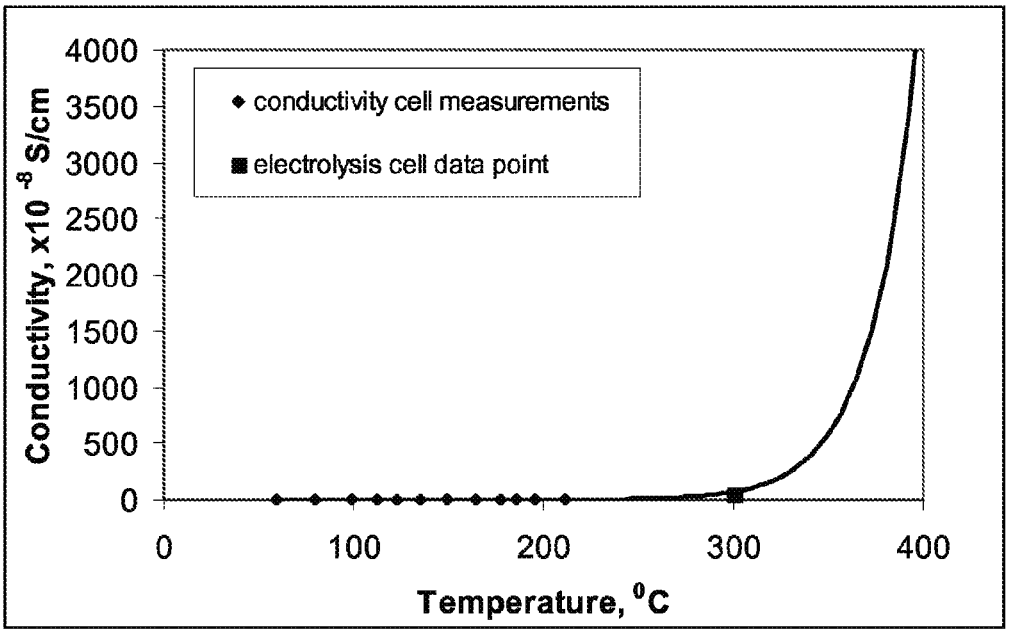
FIG. 2 hereof is a plot of the same measured electrical conductivity versus temperature for the Athabasca bitumen plotted on a linear scale.

[5]

tivity of heavy oils (in particular bitumens) at temperatures up to about 300° C. (572° F.) and have demonstrated an exponential increase in electrical conductivity with temperature as illustrated in FIGS. 1 and 2 hereof. It is believed that the electrical conductivity in crudes and residues is primarily carried by electron-hopping in the π-orbitals of aromatic and heterocyclic molecules present in these heavy oil species. Experimental support for this is illustrated by the data shown in FIGS. 1 and 2 hereof.

Here, the electrical current density for a Athabasca (Canadian) bitumen (with no added water or electrolytes) was measured in a conductivity cell at various temperatures at from about 60° C. to about 200° C. (140-392° F.) and in an electrolysis cell at about 300° C. (572° F.) and the results as plotted in an exponential scale in FIG. 1. This same data is shown plotted on a linear scale in FIG. 2. What has been discovered is that when the bitumen feedstream was raised to high temperature of about 300° C. (572° F.), the conductivity increased significantly. This is led to the discovery that at high temperatures, preferably above about 300° C. (572° F.), the conductivity of the bitumen increased drastically, and was significantly high enough to allow the electrochemical desulfurization of these heavy oils without the need for adding water or electrolytes as required in the prior art. In preferred embodiments, the electrochemical process of the present invention is run with the sulfur-containing heavy oil feedstream at temperatures of at least 300° C. (572° F.), more preferably above about 350° C. (662° F.), even more preferably above about 375° C. (707° F.), and most preferably above about 400° C. (752° F.). In preferred embodiments, the sulfur-containing heavy oil feedstream is comprised of at least 50 wt %, more preferably at least 90 wt %, bitumen.

TABLE 1

Thermal Decomposition of 2-Phenylthiophenol (0.1M) in Tetralin

| Temp. (° C.) | Time (h) | 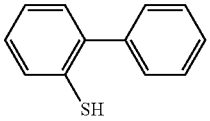 | 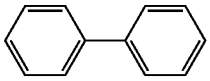 | 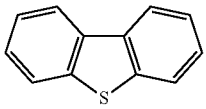 | 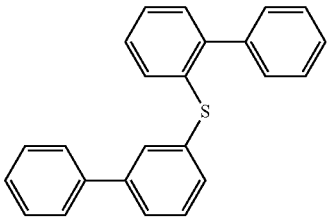 |
|---|---|---|---|---|---|
| 400 | 0 | 100% | 0 | 0 | 0 |
| | 2 | 22.1% | 60.4% | 4% | 12.5% |
| | 4 | 29.3% | 53% | 4.7% | 12% |
| 375 | 1 | 83.6% | 11.9% | 1.3% | 3.1% |
| | 3 | 59.7% | 31% | 3.8% | 5.4% |
| 350 | 1 | 95.1% | 3.6% | | 1.3% |
| | 4 | 72.6% | 17.4% | 5.7% | 4.3% |

As Examples 2 through 5 clearly demonstrate, the biphenyl mercaptan can be desulfurized by thermal treatment. This reaction could occur simultaneously with electrochemical processing if conducted at sufficient elevated temperatures or may require a separate thermal soak step.

A second embodiment or discovery of the present invention, is that in this embodiment, the process of the present invention can be operated without the addition of an electrolyte when heavy oil is the feedstream. Instead of using electrolytes, this embodiment of the invention herein relies on the intrinsic conductivity of the heavy oil at elevated temperatures. It will be understood that the term "heavy oil" and "heavy oil feedstream" as used herein includes both bitumen and other heavy oil feedstreams, such as crude oils, atmospheric resids, and vacuum resids. This process is preferably utilized to upgrade bitumens and/or crude oils that have an API gravity of less than about 15. The inventors hereof have undertaken studies to determine the electrochemical conduc- This elimination of electrolytes, by running the electrochemical process at these elevated temperatures without water or electrolytes, results in significant savings in costs for supplying, adding and recovering electrolytes from the processes. This also results in reduced water management as well as the corrosive environment which results from utilizing water as an electrolyte.

However, unlike crudes, bitumens and resids, performing controlled potential electrolysis on a non-conductive fluid such as petroleum distillate streams, requires the introduction of an effective amount of an electrolyte, such as a conductive salt. Here, the first embodiment of the present invention described above can be utilized on non-conductive hydrocarbon fluids in conjunction with the use of effective electrolytes. The direct addition of a conductive salt to the distillate feedstream can be difficult for several reasons. The term "effective amount of electrolyte" as used herein means at least an amount needed to produce conductivity between the anode and the cathode of the electrochemical cell. Typically this amount will be from about 0.5 wt. % to about 50 wt. %, preferably from about 0.5 wt. % to about 10 wt. %, of added electrolytic material based on the total weight of the feed plus the electrolyte. Once dissolved in the oil, most salts are difficult to remove after electrolysis. Incomplete salt removal is unacceptable due to product specifications, negative impact on further catalytic processing, potential corrosivity and equipment fouling. Even salts that are soluble in a low dielectric medium are often poorly ionized and therefore unacceptable high concentrations are required to achieve suitable conductivities. In addition, such salts are typically very expensive. However, recent advances in the field of ionic liquids have resulted in new organic soluble salts having melting points lower than about 212° F. (100° C.) that can be used in the present invention. They can be recovered by solvent washing the petroleum stream after electrolysis. Non-limiting examples of such salts include: 1-butyl-1-methylpyrrolidinium tris(pentafluoroethyl)trifluoro phosphate, 1-butyl-1-methyl pyrrolidinium trifluoro-methyl sulfonated, trihexyltetradecylphosphonium tris(pentafluoroethyl)trifluorophosphate and ethyl-dimethylpropyl-ammonium bis(trifluoro-methylsulfonyl)imide.

An alternate solution to the low conductivity problem of distillate boiling range feedstreams to produce a two phase system. Rather than adding an electrolyte to the feedstream, the feedstream can be dispersed in a conductive, immiscible, non-aqueous electrolyte. Such a two-phase system of oil dispersed in a continuous conductive phase provides a suitable electrolysis medium. The continuous conductive phase provides the sufficient conductivity between the cathode and anode of an electrochemical cell to maintain a constant electrode potential. Turbulent flow through the electrochemical cell brings droplets of the feedstream in contact with the cathode, at which point electrons are transferred from the electrode to sulfur containing species on the droplet surface.

After reaction, the immiscible electrolyte from the treated feedstream is separated by any suitable conventional means resulting in a reduced sulfur product stream. The immiscible electrolyte can be recycled. The electrolyte in the immiscible electrolysis medium is preferably an electrolyte that dissolves, or dissociates, in the solvent to produce electrically conducting ions, but that does not undergo a redox reaction in the range of the applied potentials used. Suitable organic electrolytes for use in the present invention, other than those previously mentioned, include quaternary carbyl- and hydrocarbyl-onium salts, e.g., alkylammonium hydroxides. Non-limiting examples of inorganic electrolytes include, e.g., NaOH, KOH and sodium phosphates, and mixtures thereof. Non-limiting examples of onium ions that can be used in the practice of the present invention include mono- and bis-phosphonium, sulfonium and ammonium, preferably ammonium. Preferred carbyl and hydrocarbyl moieties are alkyl carbyl and hydrocarbyl moieties. Suitable quaternary alkyl ammonium ions include tetrabuytyl ammonium, and tetrabutyl ammonium toluene sulfonate. Optionally, additives known in the art to enhance performance of the electrodes can also be used. Non-limiting examples of such additives suitable for use herein include surfactants, detergents, emulsifying agents and anodic depolarizing agents. Basic electrolytes are most preferred. The concentration of salt in the electrolysis medium should be sufficient to generate an electrically conducting solution in the presence of the feedstream. Typically, a concentration of about 1 to about 50 wt % conductive phase, preferably about 5 to about 25 wt % based on the overall weight of the oil/water/electrolyte mixture is suitable. It is preferred that petroleum stream immiscible solvents be chosen, such as dimethyl sulfoxide, dimethylformamide or acetonitrile.

Dispersions are preferred for ease of separation following electrolysis. However, more stable oil-in-solvent emulsions can also be used. Following electrolytic treatment, the resulting substantially stable emulsion can be broken by the addition of heat and/or a de-emulsifying agent.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for removing sulfur from a sulfur-containing petroleum feedstream having at least a portion of its sulfur in the form of hindered dibenzothiophene compounds, comprising:

a) passing a sulfur-containing petroleum feedstream to an electrochemical cell in the substantial absence of hydrogen and water;

b) subjecting said sulfur-containing petroleum feedstream to an effective voltage and current that will result in the conversion of at least 5 wt % of said hindered dibenzothiophene compounds wherein at least 25 wt % of these converted hindered dibenzothiophene compounds are mercaptan compounds, thereby producing an electrochemically treated petroleum feedstream;

c) passing the electrochemically treated petroleum feedstream containing said mercaptans compounds to a mercaptan treatment zone wherein it is contacted with an aqueous caustic solution wherein mercaptan-containing compounds are extracted by the aqueous caustic solution; and d) collecting a reduced mercaptan sulfur petroleum product stream from the mercaptan treatment zone;

wherein the reduced mercaptan sulfur petroleum product stream has a lower sulfur content by wt % than the electrochemically treated petroleum feedstream.

2. The process of claim 1, wherein step a) is performed in the presence of a nitrogen gas environment.

3. The process of claim 1, wherein at least a portion of the mercaptan compounds are alkylated biphenyl mercaptan compounds.

4. The process of claim 1, wherein the electrochemical cell is run at about 4 volts to about 500 volts and a current density of about 10 to about 1000 $mA/cm^2$.

5. The process of claim 1, wherein the aqueous caustic solution is a sodium hydroxide solution.

6. The process of claim 1, wherein the sulfur-containing petroleum feedstream is a distillate boiling range hydrocarbon stream and an effective amount of an electrolyte is mixed with the distillate boiling range hydrocarbon stream.

7. The process of claim 6, wherein the distillate boiling range hydrocarbon stream is a low sulfur automotive diesel oil.

8. The process of claim 6, wherein the electrolyte is an organic electrolyte.

9. The process of claim 8, wherein the organic electrolyte is selected from quaternary carbyl- and hydrocarbyl-onium salts.

10. The process of claim 8, wherein the organic electrolyte is comprised of an organic soluble salt selected from the group consisting of 1-butyl-1-methylpyrrolidinium tris(pentafluoroethyl)trifluoro phosphate, 1-butyl-1-methyl pyrrolidinium trifluoro-methyl sulfonated, trihexyltetradecylphosphonium tris(pentafluoroethyl)trifluorophosphate and ethyldimethylpropyl-ammonium bis(trifluoro-methylsulfonyl) imide.

11. The process of claim 6, wherein the electrolyte is an inorganic electrolyte selected from the group consisting of sodium hydroxide, potassium hydroxide and sodium phosphates.

12. The process of claim 1, wherein the sulfur-containing petroleum feedstream is comprised of a heavy oil selected from bitumen, crude oil, atmospheric resid and vacuum resid.

13. The process of claim 12, wherein the sulfur-containing petroleum feedstream is substantially absent of any electrolytes and the sulfur-containing petroleum feedstream in step b) is at a temperature of at least 300° C. (572° F.).

14. The process of claim 13, wherein the sulfur-containing petroleum feedstream in step h) is at a temperature of at least 375° C. (707° F.).

15. The process of claim 13, wherein the sulfur-containing petroleum feedstream has a conductivity of at least $1\times10^{-5}$ Siemens/cm$^2$.

16. The process of claim 15, wherein the sulfur-containing petroleum feedstream is comprised of at least 50 wt % bitumen.

17. The process of claim 16, wherein the sulfur-containing petroleum feedstream is comprised of at least 90 wt % bitumen.

18. The process of claim 17, wherein step a) is performed in the presence of nitrogen.

19. The process of claim 17, wherein at least a portion of the mercaptan compounds are alkylated biphenyl mercaptan compounds.

20. The process of claim 1, wherein sulfur-containing petroleum feedstream contains less than 1 wt % molecular hydrogen and less than 2 wt % water.

21. The process of claim 1, wherein sulfur-containing petroleum feedstream contains only trace amounts of molecular hydrogen and trace amounts of water.

22. The process of claim 1, wherein the electrochemically treated petroleum feedstream has a higher mercaptan sulfur content by wt % than the sulfur-containing petroleum feedstream.

* * * * *